United States Patent [19]

Levey et al.

[11] 4,377,838

[45] Mar. 22, 1983

[54] ELECTROSTATIC SPRAY GUN APPARATUS

[75] Inventors: Gustave S. Levey; Clarence C. Reeves, both of Houston; Donald R. Owens, Baytown, all of Tex.

[73] Assignee: Speeflo Manufacturing Corporation, Houston, Tex.

[21] Appl. No.: 207,702

[22] Filed: Nov. 17, 1980

[51] Int. Cl.[3] ..... B05B 5/02

[52] U.S. Cl. ..... 361/228; 361/235

[58] Field of Search ..... 361/227, 228, 235; 239/690, 706, 707; 363/59

[56] References Cited

U.S. PATENT DOCUMENTS

| | | | |
|---|---|---|---|
| 3,731,145 | 5/1973 | Senay | 361/235 X |
| 4,196,465 | 4/1980 | Buschor | 361/235 X |
| 4,290,091 | 9/1981 | Malcolm | 361/228 |

FOREIGN PATENT DOCUMENTS

| | | | |
|---|---|---|---|
| 2304411 | 11/1976 | France | 239/707 |

*Primary Examiner*—Harry E. Moose, Jr.

*Attorney, Agent, or Firm*—Pearne, Gordon, Sessions, McCoy & Granger

[57] ABSTRACT

A hand-manipulable electrostatic spray gun is disclosed which is one requiring no electric cable attached to it. Within the hand-manipulable spray gun an air turbine is driven at high speed in the order of 60,000 rpm and drives directly an alternator to generate an alternating voltage in the order of 50 volts at about 1000 Hz. The output of this alternator is supplied to a step-up transformer to achieve a secondary voltage in the order of 2500 volts. From here, it is supplied to a long chain series voltage multiplier to increase the voltage thereof to one in the order of 55–80 kilovolts. The combination of a relatively small transformer and small capacitance establishes a direct voltage output from the voltage multiplier which has an alternating voltage ripple in excess of fifteen percent. The foregoing abstract is merely a resume of one general application, is not a complete discussion of all principles of operation or applications, and is not to be construed as a limitation on the scope of the claimed subject matter.

13 Claims, 6 Drawing Figures

ELECTROSTATIC SPRAY GUN APPARATUS

BACKGROUND OF THE INVENTION

Electrostatic spray coating is used for the deposition of coating materials upon a workpiece and electrostatic spraying enhances the amount of coating material received on the workpiece by means of the electrostatic field between the spray gun and the workpiece. This electrostatic field is established at or adjacent to the atomizing outlet of the spray gun whether the coating material is pneumatically or hydraulically atomized. The electrostatic potential is normally generated with a conventionally produced direct current source of between 30 and 150 kilovolts. The most usual working voltage for hand-held spray guns is in the 50–60 kilovolt range, so that the generally desirable minimum gradient of 5 kilovolts per inch can be established between the high voltage charging area and the object being sprayed, with a normal 10-inch separation between the head of the gun and the workpiece. This is described in the Juvinall et al. U.S. Pat. No. 3,048,498, and produces a direct current output with minimum AC ripple in the output, less than 10% ripple.

It has been recognized that higher charging voltages generally increase the electrostatic attractive force. The ability to spray uniformly a cylindrical object from a single lateral direction is a measure of the "wrap" efficiency and is indicative of the magnitude of electrostatic force and DC voltage.

The prior art has disclosed three basic systems for producing electrostatic potential for electrostatic spray coating of material. The oldest is the use of a conventional high voltage transformer, energized at commercial frequencies, e.g., 60 Hz, supplying a half or full-wave rectifier. This is a fixed unit and supplies the high voltage output, commonly 55 kilovolts DC, by means of a coaxial cable to the spray gun. The second known system is the electrogasdynamic system in which the power supply output is physically smaller and has a very low power supplying an output of about 5 kilovolts, which potential is carried to the spray gun by a coaxial cable, and this potential is used to generate a cumulative charging of a supersonic column of alcohol-laden air, which at its output creates a DC potential of 55 kilovolts or higher, depending upon several variable factors. This system is illustrated in the Cowan U.S. Pat. Nos. 3,651,354 and 3,791,579. Like the first system, it requires a separate power supply and electric cable from such power supply to the spray gun.

The third prior art system is illustrated in the Malcolm U.S. Pat. No. 4,219,865, which dispenses entirely with an electrical cable connected to the spray gun and, instead, utilizes six miniaturized components within the spray gun, with components to achieve the high voltage in six steps. These six components include an alternator, rectifier, oscillator, transformer, and a voltage multiplier. The turbine is an air-driven turbine driving an alternator producing about 15 volts, which is rectified, and then this operates an oscillator operating at about 20 kilohertz at 12 volts. The oscillator has a square wave output which can be multiplied in a toroidal transformer to a value of about 2500 volts. This, in turn, is multiplied by a conventional cascade halfwave voltage multiplier of about 20 stages to produce a normal 50–55 kilovolt output. The cascade multiplier is a half-wave rectifier, and this oscillator-to-multiplier system is designed to produce the 55 kilovolts as a DC voltage with a minimum of ripple voltage or peaks because the square wave input being rectified makes a practically constant DC output. This third system produces spray painting results which are generally equivalent to the Cowan second prior art system or the system shown in the Juvinall patent.

In all these three prior art systems, the objective is a uniformly charged paint particle, charged at or about the uniform DC voltage output generated by the system. As may be observed from the teachings of the prior art systems, the first and second systems are burdened with the objectionable electric cable, which may be stiff and bulky, and can hamper the operation of the spray gun. The third system has a rather complex sequence of five electrical components, i.e., the alternator, the rectifier, the oscillator, the toroidal transformer, and associated electronic regulating devices needed to convert the simple low voltage of about 12 volts AC to a controlled level sufficiently high to provide a minimum input to the series voltage multiplier. It has been observed that the circuitry just described, necessary for the conversion of low voltage, low frequency, e.g., 250 Hz at 12 volts, into high frequency and higher voltage, e.g., 20 KHz at 2500 volts, is subject to overheating and breakdown of the components when they have been miniaturized sufficiently for installation in a hand gun.

This third system is designed for a uniform square wave output from the oscillator so that when run through the series voltage multiplier, it is a DC output free from excessive ripple or peaks. Currently manufactured systems of this third type have been prone to premature failure under constant duty, as distinguished from intermittent duty.

The problem to be solved, therefore, is how to construct a spray gun apparatus which may be hand-manipulable and which has small, lightweight components so that the spray gun is not burdened by being connected by means of an electrical cable to any external apparatus, yet a high voltage is established with safety to the spray gun operator and which has high "wrap" efficiency.

SUMMARY OF THE INVENTION

This problem is solved by an electrostatic spray gun comprising, in combination, a hand-manipulable frame, an air turbine carried in said frame and operable from an external air supply at a speed in the order of 60,000 rpm, an alternator carried in said frame and directly coupled to said turbine to generate an alternating voltage in the order of 50 volts at about 1000 Hz, a step-up transformer carried in said frame and connected to said alternator to transform the voltage thereof into a secondary voltage in the order of 2500 volts, and a long chain series voltage multiplier carried in said frame and connected to said transformer to increase the voltage thereof to one in the order of 55–80 Kv, the combination of said transformer and said capacitors establishing a direct voltage output from said voltage multiplier with an alternating voltage ripple in excess of fifteen percent.

Accordingly, an object of the invention is to provide a more simplified spray gun apparatus which incorporates components with a longer life and less subject to premature failure.

Another object of the invention is to simplify the production of an AC potential large enough to serve as a useful input voltage to a series voltage multiplier which, although constructed to fit in the same dimensional and weight constraints of the gun of the Malcolm U.S. Pat. No. 4,219,865, is nevertheless one which avoids the overheating and energy loss characteristics of the Malcolm oscillator and toroidal transformer construction. In this regard, it must be noted that a toroidal transformer inherently requires good heat dissipation for satisfactory constant duty operation because on winding is toroidally wound over the other winding.

Another object, therefore, is to simplify the conversion of the alternating current low voltage output from an air-driven turbine alternator to the input of a series voltage multiplier.

Another object of the invention is to eliminate electronic circuitry and the attendant heat producing problems of the plural number of separate electrical components in the prior art systems.

A still further object of the invention is to produce a spray gun with an output of approximately 55 Kv without excessive peak voltage which would exceed the voltage ratings of the components of the series voltage multiplier.

Still another object of the invention is to utilize the previously objectionable voltage peaks in the final output voltage to charge the coating particles to the highest level of the peak voltages, e.g., 70–80 Kv, with a device producing an average DC voltage of only 50–55 Kv.

Another object of the invention is to provide a hand-held spray gun operating in the 50–55 Kv range which has greater "wrap" efficiency than the prior art hand-held guns operating in the same voltage range.

Still another object of the invention is to provide a hand-held spray gun with capacitors of significantly lower capacity than used in the third prior art system in order to significantly improve the "wrap" efficiency of spray coating a workpiece.

Other objects and a fuller understanding of the invention may be had by referring to the following description and claims, taken in conjunction with the accompanying drawing.

DESCRIPTION OF THE PREFERRED EMBODIMENT

Figure 1:
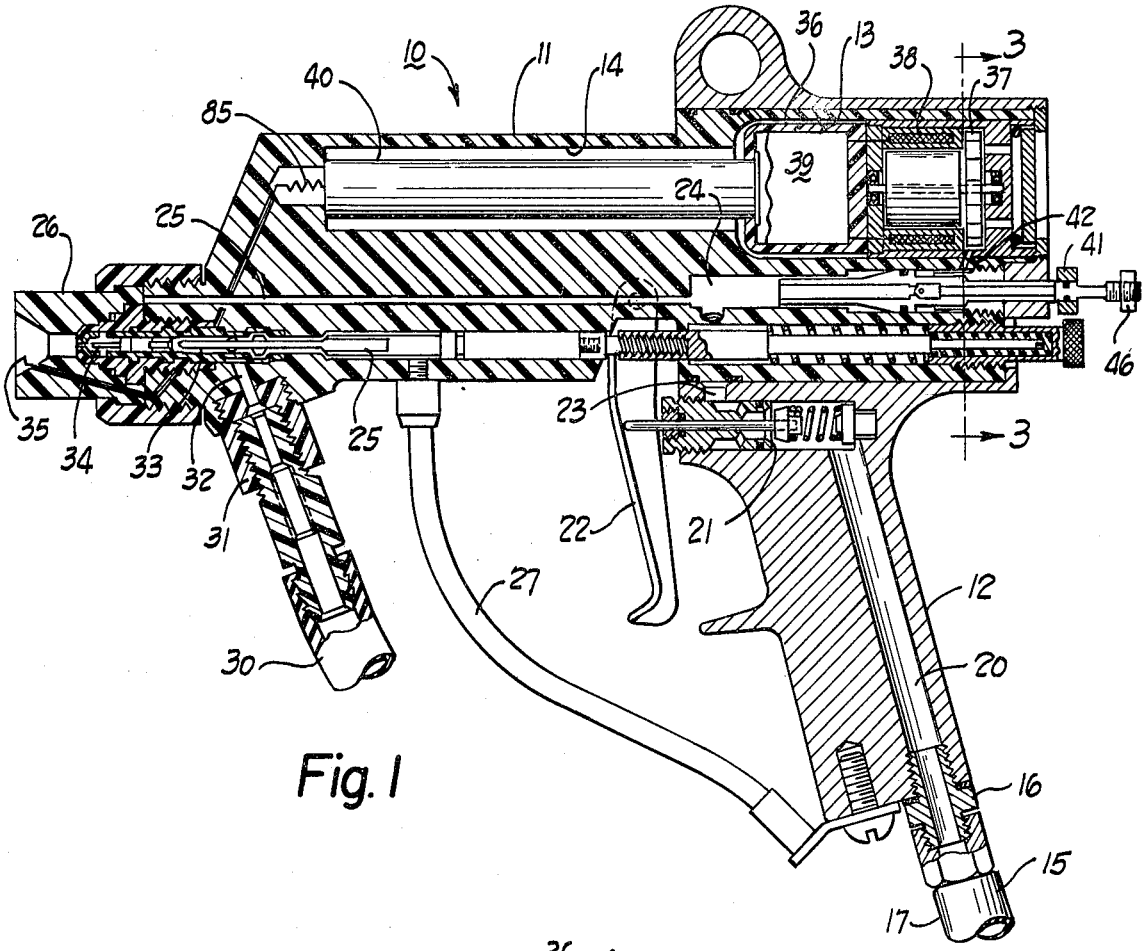
FIG. 1 is a longitudinal view, mostly in section, of a spray gun embodying the invention.

The figures of the drawing illustrate a spray gun 10 which may be of the airless or hydraulically atomized type, although it is illustrated as the air pressure or pneumatically atomized type. The gun 10 may be of the automatically operated type, but is illustrated as the hand-manipulable type of electrostatic spray gun for spraying paint or other coating material. This spray gun includes a generally cylindrical barrel 11 of high dielectric insulating material attached to a handle 12 of the pistol-grip type which has at least a metallic coating for grounding purposes. The rear of the handle 12 includes a generally cylindrical chamber 13 merging with a further smaller cylindrical chamber 14 within the barrel 11. An air hose 15 is connected, by means of a fitting 16, to the bottom of the handle 12, and this hose 15 is connected to a remote source of substantially constant pressure compressed air (not shown), which suitably may be a conventional regulated, compressed air supply, e.g., 70 psi, with a flow rate of at least 3 cfm. A metallic coating 17 on the air hose 15 serves as a ground connection for the handle 12 of the gun 10.

An air flow conduit 20 within the handle connects to the air inlet hose 15, and air flow through the gun is controlled by a valve 21 controlled by a trigger 22. A guard 27 is provided for the trigger. The output side of the valve 21 supplies a conduit 23, which in turn supplies a manifold 24. From this manifold, a longitudinal conduit 25 within the lower part of the barrel 11 may supply compressed air to a cap assembly 26. This cap assembly may be conventional in nature, such as illustrated in U.S. Pat. Nos. 3,645,447 or 3,843,052. The air flow in the longitudinal conduit 25 may be used in an airless gun as an air supply for fan shaping of the emitted spray of the atomized coating material, or it may be used in an air-atomized gun to convey a flow of compressed air to the cap assembly 26 to be used in the conventional air-induced atomization of the coating material introduced from a remote supply source and supplied through a coating material hose 30. This coating or paint material hose 30 is connected at a fitting 31, and is supplied by a conduit 32 through valve 33 to the airless spray tip 34. The cap assembly 26 may incorporate the conventional electrode 35, as in the aforementioned patents. The valve 41 at the rear of the gun controls air for atomizing the coating material in an air spray gun, or may control the fan shape of coating material in an airless gun when such air assist mode is used.

A cartridge 36 is disposed within the chambers 13 and 14, and this cartridge is that which changes air pressure into mechanical motion, and then into electrical energy of a suitably high voltage, an average of 50–55 Kv. This cartridge includes generally four main items: an air turbine 37, an alternator 38, a transformer 39, and a voltage multiplier 40, all held together with an external shell 45. The first three items are within the enlarged chamber 13, and the voltage multiplier 40 is within the smaller diameter cylindrical chamber 14 in the gun barrel 11.

When the cartridge 36 is properly seated within the cylindrical chambers 13 and 14, air from the air manifold 24 flows through an auxiliary manual valve 46 terminating at an input nozzle 42, whereat it is directed generally tangentially against a turbine wheel 43 of the air turbine 37. This air turbine is small, the rotor being only about 2.5 cm in diameter, and under normal operating air pressure of about 70 psi, it is capable of speeds of about 60,000 rpm. The air flow through the turbine 37 is exhausted to atmosphere through an exhaust conduit 44, and then through a muffler 59.

The inlet conduit is an angularly directed hole of approximately 0.035 inch in diameter, which admits sufficient air to operate the turbine alternator and to accelerate the turbine to the necessary 60,000 rpm in one second or less.

Figure 2:
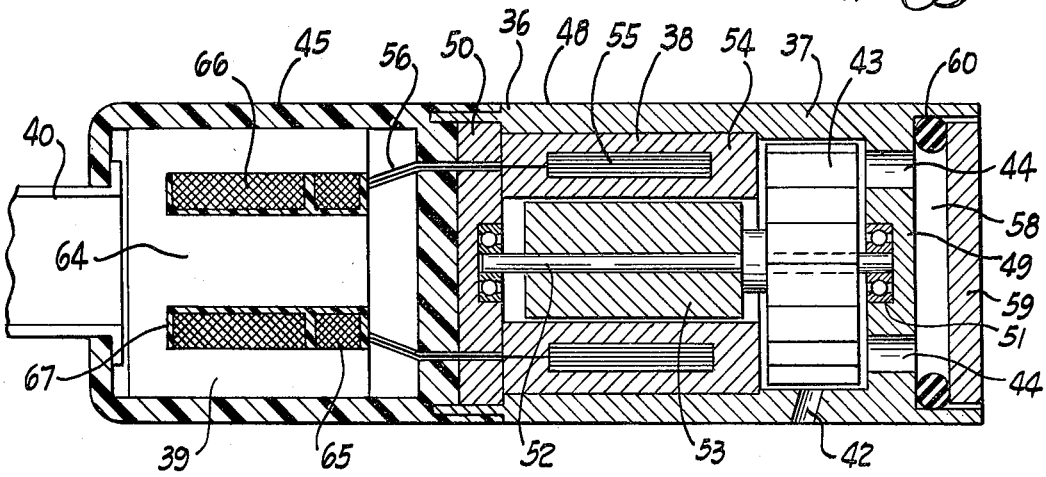
FIG. 2 is an enlarged, longitudinal sectional view of the turbine, alternator, and transformer of the invention.
Figure 3:
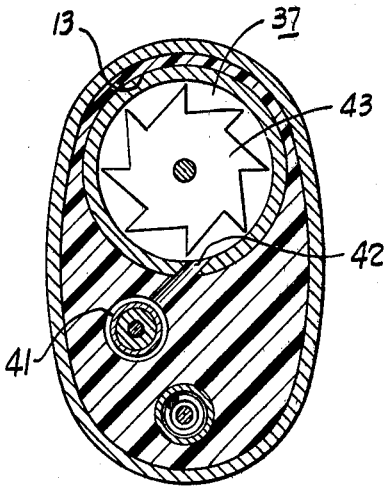
FIG. 3 is an enlarged cross sectional view on line 3—3 of FIG. 1.

FIG. 2 better illustrates the construction of the air turbine 37 and the alternator 38. The shell housing 48 has an end wall 49 and a removable end wall 50 which mount high speed bearings 51. A shaft 52 is journaled in these bearings and the turbine wheel 43 is secured on this shaft and an alternator rotor 53 is also secured on this same shaft. This rotor is a permanent magnet, magnetized transversely, and may be a four-pole or may be a two-pole as illustrated. The alternator 38 includes a magnetically permeable stator 54, with at least one stator winding 55 having leads 56 passing through the end wall 50.

The turbine wheel 43 is of lightweight construction, for example, made of some high strength plastic such as Delrin about 2.5 cm in diameter and about 0.6 cm thick. This makes a lightweight unit which has minimum inertia for rapid acceleration. The turbine 37 has the air exhaust 44 into an exhaust manifold 58, and from there through a perforated muffler disc 59 to the atmosphere. This muffler disc may seal the exhaust manifold 58 by means of an O-ring 60, and the muffler disc may be a sintered ceramic or porous metal disc to permit the exhaust of the air and to act as a muffler.

The transformer 39 is also shown in FIG. 2, and has a suitable magnetically permeable core 64, such as a laminated steel E-I core, with a primary winding 65 connected to the alternator stator winding 55 and with a step-up secondary winding 66, in this preferred embodiment, of about 44:1. The primary and secondary windings are each wound separately on a bobbin 67, so that neither is wound on top of the other, hence promoting good heat conductivity to the core. the alternator rotor 53 is only about 1.2 cm in diameter and about 2 or 2.5 cm long for low inertia, and therefore the combination of the turbine rotor 43 and alternator rotor 53 will be capable of acceleration to full speed of about 60,000 rpm in approximately one second. The acceleration to half speed of about 30,000 rpm is within about a half second.

Figure 4:
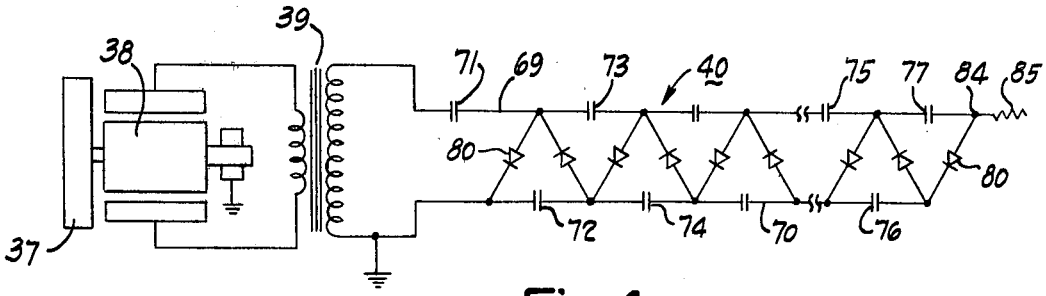
FIG. 4 is a schematic electrical diagram of the circuit of the gun.

FIG. 4 illustrates the series voltage multiplier, and illustrates in rather diagrammatic form the turbine 37, alternator 38, and transformer 39. This voltage multiplier 40 is of the series or cascade half-wave rectifier type of long chain or ladder-type multiplier. Twenty to 24 stages may be utilized, with each stage including a capacitor and a diode. More specifically, the voltage multiplier includes a first branch 69 and a second branch 70. The first branch 69 includes a first capacitor 71 and additional capacitors 73, 75, and 77. The second branch 70 includes series-connected capacitors 72, 74, and at least capacitor 76. Diodes 80 are connected in a ladder fashion between the junctions of the capacitors in each branch to form the usual series voltage multiplier. An output terminal 84 supplies a high voltage, preferably a negative voltage, through a limiting resistor 85, to the electrode in the cap assembly 26 for charging the paint particles.

OPERATION

When the trigger 22 is partially squeezed, valve 21 opens first, and the air reaches the turbine to activate the alternator. Then, as the trigger is fully actuated, the paint through hose 30 is delivered as valve 33 is actuated. Air pressure is supplied to the air manifold 24 to be used in the airless or air-type gun at the cap assembly 26, and also to drive the turbine 37. The turbine wheel 43 rapidly accelerates to its operational speed of about 60,000 rpm within one second of time, and in one gun constructed in accordance with the invention, this acceleration was within about one-half second. This is due to the very low inertia of the turbine wheel 43 and alternator rotor 53. The alternator at this speed of operation generates about 50 volts, and with 60,000 rpm and a two-pole alternator, this is 1000 Hz. This output, in turn, is multiplied in the step-up transformer 39 with a turns ratio of about 50:1 to produce about 2500 volts. The alternator output is essentially a sine wave, as is the transformer 39 output, which is supplied to the voltage multiplier 40. With the selection of a 1000-cycle alternator, i.e., 60,000 rpm, it is practical to design a sufficiently small transformer for the physical size limitation of the gun.

The voltage multiplier includes capacitors 71–77 which are lower in capacity than those in the gun of the Malcolm U.S. Pat. No. 4,219,865. In such gun, the first capacitor, such as capacitor 71, was 3300 picofarads, and the remaining capacitors averaged about 2500 pf, in some guns tapering in size to about 2200 pf in later stages.

Conventional multiplier design requires that the first capacitor be of substantially higher capacitance than the following capacitors in the cascade system to assure satisfactory regulation and minimum AC ripple, and that each of the capacitors be of adequate capacitance to provide sufficient current output without excessive potential drop as the number of stages increases. The subject invention exploits the reverse of the conventional design by using the same size capacitor in all stages of only about 1500 to 2000 pf capacitors in all stages of the multiplier, recognizing that the tendency of an "unconventional" multiplier so constructed will provide adequate microamperage for electrostatic charging of the particles, but upon close approach of the device to a grounded object the voltage will diminish rapidly with current increase, which is an added safety factor in that any tendency to arc from gun electrode to ground is minimized by the reduced voltage.

The Malcolm U.S. Pat. No. 4,219,865 states that it has an oscillator which may have either a square wave or a sine wave output. As a practical matter, the guns manufactured by Malcolm were all guns which had a square wave output. This was because the oscillator transistors went to saturation alternately, and hence inherently achieved the square wave output. This was desirable according to the teachings of the prior art because it was always thought that one should minimize the AC ripple in the DC output at the cap assembly 26. Applicant, on the other hand, has discovered that a ripple in excess of 15 percent, and preferably in the order of 20–40 percent, coupled with the frequency of this ripple of about 1000 Hz, achieves remarkably improved results. These improved results are shown by the "wrap" efficiency, where a cylindrical workpiece, when sprayed from one transverse side, is found to be more uniformly covered 360 degrees around the periphery with a minimum of overspray onto a flat surface about 30 to 40 cm behind the cylindrical object.

In all three of the prior art systems mentioned above, the objective was a uniformly charged paint particle charged at or about the average DC voltage generated by the system. The first and second prior art systems were burdened with the objectionable electrical cable, and the third prior art system had a rather complex sequence of electronic components which were subject to overheating and premature failure when operated in constant duty. The present invention has simplified production of this high voltage alternating current which is supplied to the voltage multiplier 40 so that it may properly act to produce an average voltage of about 50–55 Kv. More importantly, the alternating current peaks on the ripple of this average DC voltage are about 70 Kv, with the valleys between peaks being at about 45 Kv. The present system, having only three electrical components rather than the five of the Malcolm U.S. Pat. No. 4,219,865, is of great simplicity in the production of the high direct voltage at the output electrode of the gun.

Figure 5:
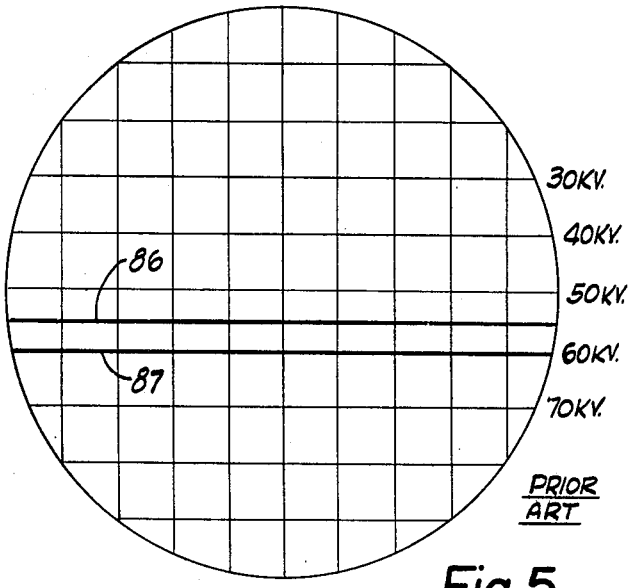
FIG. 5 is an oscilloscope diagram of the prior art waveform.
Figure 6:
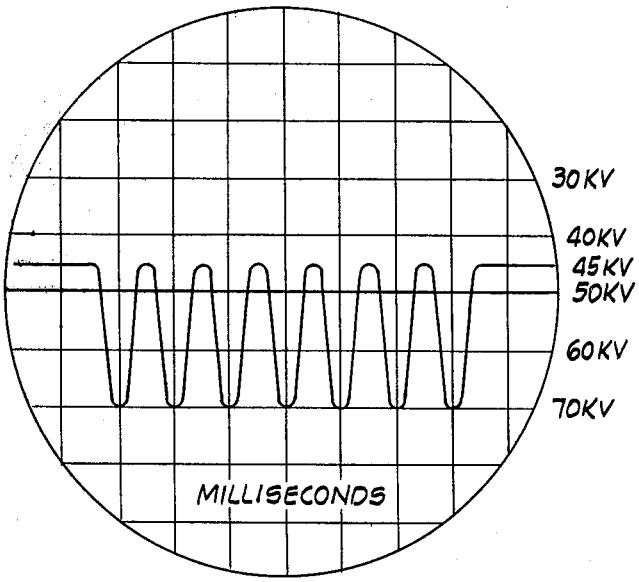
FIG. 6 is an oscilloscope diagram of the waveform of the present invention.

The prior art spray guns were all designed to eliminate these high peak voltages, because it was thought that these peak voltages would provide an unsatisfactory spray pattern. FIG. 5 is a waveform diagram 86 of the prior art negative voltage at the gun output electrode, from the gun of the Malcolm U.S. Pat. No. 4,219,865. This shows a negligible ripple voltage in the output. The voltage output from the Ransburg gun produces a similar waveform 87 with no appreciable ripple. However, applicants have discovered that the particular combination of elements of the invention has achieved a superior spray painting efficiency. The electrostatic field created by the gun is one which is greater than normal for the standard output of 50–55 Kv. This is apparently due to the peak voltages of about 70–80 Kv in the ripple of the DC output. This has been confirmed by oscilloscope observations, and FIG. 6 is a waveform diagram of the negative output voltage from a gun constructed according to the present invention, with an AC ripple voltage of 25 Kv peak to peak out of an average value of 55 Kv, or about 40 to 45 percent ripple.

It has been discovered that the present invention uniquely utilizes the previously objectionable voltage peaks to charge the paint particles, or at least an acceptable proportion of these particles, to the highest level of the peak voltages, e.g., 70–80 Kv, with an electrical circuit which is capable of producing no more than 50–55 Kv average DC output. The results were completely unexpected, and the "wrap" efficiency has been significantly increased, so that the paint deposition efficiency exceeds, according to our tests, any conventional hand-held device normally operated in the 50–55 Kv range, and compares favorably with the efficiency of the very high voltage automatic systems which could not with safety be hand-held.

Although the quantitative improvement achieved by this invention will be apparent to anyone skilled in the art who uses the gun, we have made quantitative measurements of deposition efficiency in actual spray tests.

The test equipment includes a tubular spray grid consisting of 24 one-inch metal tubes, 42 inches long, mounted vertically on three-inch centers with horizontal tubes at the top and bottom to provide rigidity to this 42"×72" grid. The grid is electrically connected to ground.

Thirty to forty-five cm behind the tubular grid is a solid backboard, parallel to the tubular grid, upon which backboard a sheet of aluminum foil is attached and which is also connected to ground. This is the "overspray capture target."

A spray gun, air atomizing or airless type, is rigidly mounted perpendicular to and approximately thirty-five cm laterally in front of the tubular grid, and the gun delivery set for a predetermined flow rate, e.g., 100 cc per minute at a fixed pressure, e.g., 12 psi on the material pressure tank or 800 psi on an "airless" hydraulically atomizing gun.

The spray gun may be of the type illustrated in Malcolm U.S. Pat. No. 4,219,865, with a conventional electrostatic power cartridge which measures typically 50 Kv through a 5000 megohm resistor for 10 microamperes current flows. The gun may be of the air atomizing or of the "airless" type. Our tests include quantitative comparison of deposition efficiency of said Malcolm guns (air and airless) by interchanging the electrostatic power cartridge of the invention with the electrostatic power cartridge of the "Malcolm" guns with prior adjustment of the average DC voltage output of the invention to identically correspond with each other to assure valid results (approximately 50 Kv). Specifically, we find that for a 10-second air atomizing gun test or a five second "airless" gun test, good electrostatic spray application results can be achieved, i.e., good "wrap" coverage of the full circumference of the tubular grid exposed to the spray.

A portion of the spray particles are propelled beyond the tubular grid and are attracted to the solid target behind the grid. If the deposition efficiency were 100%, all the paint would have been attracted to the grid and none deposited on the grounded solid target located behind the grid.

For comparison of deposition efficiency of this invention with any prior art gun, the "lost overspray" deposited upon the solid target is measured for each gun under test conditions in which flow rate, material being sprayed, voltage applied, and any other relevant variables are correlated. The efficiency is determined by measuring the increase in the weight of the aluminum foil after spraying and baking of the foil for twenty minutes at 375° F. to evaporate all solvents.

A representative five second test for the weight increase of the "lost overspray" target may be about three grams on the prior art gun and about 2.3 grams on the same gun equipped with the power cartridge of the present invention. We find that there can be variations in fluid pressure, viscosity and length of spray test which still produce similar percentage improvement in deposition efficiency. The distance at which the solid target is separated from the grid may reduce the apparent improvement because, if too close, that target will provide a stronger attraction for rapidly moving particles that have passed through the grid. We have found that the solid target should be no closer than thirty cm from the grid for air atomizing spray and about forty-five cm for "airless" spray gun comparative tests. The solid target, properly grounded, at these distance separations permits almost no overspray loss except to the solid target.

The deposition efficiency measured by the comparison of "loss target" deposition is about 25% better for guns of the present invention compared with prior art electrostatic guns tested, which represents a significant improvement in paint consumption, production costs, and pollution control.

It should be noted that the foregoing comparisons with prior art devices were made by adjusting the average gun output voltage of the present invention down to the output of the several prior art devices tested, and that when the invention is operated at its full 1000 cycle normal operation, producing approximately 60 Kv (12 microamperes), the comparative efficiency is significantly greater than the mere linear increase in voltage because the AC ripple increases in a non-linear mode with increase in average output voltage.

It is to be expected that electrostatic prior art guns of different design may be more or less efficient in deposition quality due to other factors as, for example, the electrode pin of the Juvinall U.S. Pat. No. 3,169,882. A comparison of the invention gun with a "Juvinall" gun for deposition efficiency was made and the invention produced a 33 percent efficiency improvement, notwithstanding that the tested gun of the present invention, an air atomizing type, was not equipped with the "Juvinall" electrode. It is anticipated that additional and exhaustive testing will continue, but the results to date support the fact that the invention produces an electrostatic field of greater integrity than our experience had indicated should be obtained for particular output potentials.

One theory of operation in the superior performance of the present spray gun is that the paint particles, in passing the charging electrode, the point of maximum potential at the end of the gun, will be charged at the voltage potential of the electrode depending upon the time versus voltage point of the alternating ripple voltage superimposed on the DC output voltage. Such paint particles, therefore, may be charged at 50–70 Kv for an average DC output voltage of 55 Kv.

This apparently unequal charging appears to improve the wrap efficiency because those lower charged particles are attracted to the sides of the object in the usual manner, including some wrapping, and more of the charged particles which normally would pass the object are now returned to the rear or sides of the object because of the higher electrostatic charging force of this gun, which overcomes the kinetic energy of the particles moving away from the object and which would otherwise be wasted. It is reasonable that the higher voltage, created by the peaks of the AC ripple and being impressed on a significant portion of the paint particles, has produced a new and fundamentally improved electrostatic efficiency by the peak voltage phenomenon that all other prior art systems have attempted to suppress or eliminate.

The higher frequency of operation of the Malcolm patent of about 10–50 KHz may be too high to permit the peak voltage charges on the particles, and/or the square wave cut-off limits those peak voltages to preclude the remarkable results obtained with the present invention.

In summary, the new system embodies a concept which relies upon the exploitation of the alternating voltage ripple in excess of 15 percent on the DC output voltage to generate a more effective charging of the paint particles. Also in the process, this increases the field intensity. Conversely, the first prior art system relied upon relatively large, high voltage transformers, so that the voltage doubler is limited to a few stages, the rectification is reasonably efficient, and the ripple is minimized. Also, the third system of the Malcolm U.S. Pat. No. 4,219,865, because of the small physical limitations in placing a transformer within a hand-held gun, prescribes a very small toroidal transformer with a 2500-volt secondary, in which the ripple effect is negated by means of the high frequency oscillator, to produce a square wave output for better rectifying direct current in the small power cartridge.

It is the unexpected and unusual effect of producing an "excessive" alternating current ripple on the DC output voltage that significantly improves the charging effect on the particles being sprayed. This is achieved by the voltage multiplier, which utilizes smaller than normal capacitors, and hence is one which has poorer than standard regulation and greater than average ripple. Also, the sine wave input from the transformer 39 to the voltage doubler establishes this increased alternating voltage ripple on the DC output. This use of the smaller than normal capacitors is an exploitation of inefficient rectification, and is contrary to the teaching in the prior art systems. The prior art teaches the use of 3000 to 4000 pf capacitors in the voltage doubler, and applicants have determined that 1500–2000 pf for the first capacitor 71 and for all the rest of the capacitors in the multiplier contribute to the greater ripple than in the prior Malcolm system.

Similarly, the use of the conventional transformer of the present invention, rather than the toroidal transformer as employed in Malcolm, and without the high frequency square wave oscillator of Malcolm, has produced significantly lower current output and higher AC ripple voltages. Further, the poorer regulation resulting from smaller than standard capacitors, as discussed above, gives a lower current output as the electrical output is increasingly loaded. The significantly lower current output is a safety feature in case the gun is inadvertently moved too close to some grounded object.

The present invention achieves an electrostatic spray gun wherein the alternator 38 has an output voltage in the order of 40–60 volts. Further, this alternator has an output frequency in the order of 800–1200 Hz. This voltage is supplied to the transformer 39 so that it has an output voltage in the order of 2000–3000 volts. This voltage is supplied to the voltage multiplier, which has smaller than normal size capacitors, so that this voltage multiplier has a DC output voltage in the range of 45–70 kilovolts with an AC ripple voltage in excess of twenty percent. In one gun constructed in accordance with the invention, this AC ripple was in excess of thirty percent of the average DC output voltage.

The net result is that the new system produces "wrap" efficiency comparable to 75–125 Kv conventional systems without the danger of using higher DC voltages in a hand-held system. Safety is enhanced because any increase in current, caused by accidental or inadvertent approach too close to a grounded object, results in a precipitous drop in the voltage output as a result of the inherent rectifier output inefficiency, which, for the purposes of the present invention, is fortuitously desirable.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the circuit and the combination and arrangement of circuit elements may be resorted to without departing from the spirit and scope of the invention as hereinafter claimed.

What is claimed is:

1. An electrostatic spray gun comprising, in combination, a hand-manipulable frame, an air turbine carried in said frame and operable from an external air supply at a speed in the order of 60,000 rpm, an alternator carried in said frame and directly coupled to said turbine to generate an alternating voltage in the order of 50 volts at about 1000 Hz, a step-up transformer carried in said frame and connected to said alternator to transform the voltage thereof into a secondary voltage in the order of 2500 volts at the said about 1000 Hz, and a long chain series voltage multiplier including capacitors and carried in said frame and connected to said transformer to increase the voltage thereof to one in the order of 45–70 Kv, the combination of said transformer and said capacitors establishing a direct voltage output from said voltage multiplier with an alternating voltage ripple in excess of fifteen percent.

2. A spray gun as set forth in claim 1, wherein said frame is a hand-held frame.

3. A spray gun as set forth in claim 1, wherein said alternator is a two-pole alternator.

4. A spray gun as set forth in claim 1, wherein said transformer has a core and a primary winding and a secondary winding wound separately on said core.

5. A spray gun as set forth in claim 1, wherein said transformer has a steel E-I magnetically permeable core.

6. A spray gun as set forth in claim 1, wherein said transformer operates substantially unsaturated with a generally sinusoidal output waveform.

7. A spray gun as set forth in claim 1, wherein said capacitors have a capacity sufficiently small to only partially filter the alternating voltage ripple from the multiplier output, to establish an alternating ripple output in excess of twenty percent.

8. An electrostatic spray gun comprising, in combination, a spray gun including a power cartridge consisting of air turbine, alternator, step-up transformer, and a voltage multiplier, with such total impedance as to produce a DC output voltage with an AC ripple voltage in excess of 20 percent.

9. An electrostatic spray gun as set forth in claim 8, wherein said alternator has an output voltage in the order of forty to sixty volts.

10. An electrostatic spray gun as set forth in claim 8, wherein said alternator has an output frequency in the order of 800 to 1200 Hz.

11. An electrostatic spray gun as set forth in claim 8, wherein the combination of said alternator, transformer, and voltage multiplier produces an output AC ripple in excess of thirty percent of the average DC output voltage.

12. An electrostatic spray gun as set forth in claim 8, wherein said transformer has an output voltage in the order of 2000 to 3000 volts.

13. An electrostatic spray gun comprising, in combination, a hand-manipulable frame; an air turbine carried on said frame and operable from an external air supply; an alternator carried in said frame and directly coupled to said turbine to generate a low alternating voltage; a step-up transformer carried in said frame and connected to said alternator to transform the voltage thereof into an intermediate value secondary alternating voltage at the frequency of said alternator; and a long chain series voltage multiplier carried in said frame and connected to said transformer to transform the voltage thereof to a high direct voltage output from said voltage multiplier with an alternating voltage ripple in excess of fifteen percent.

* * * * *